US008587503B2

(12) United States Patent
Muto et al.

(10) Patent No.: US 8,587,503 B2
(45) Date of Patent: Nov. 19, 2013

(54) ELECTRO-OPTICAL DEVICE, METHOD OF DRIVING ELECTRO-OPTICAL DEVICE, CONTROL CIRCUIT OF ELECTRO-OPTICAL DEVICE, AND ELECTRONIC APPARATUS

(75) Inventors: Kota Muto, Suwa (JP); Masato Nishizawa, Shiojiri (JP)

(73) Assignee: Seiko Epson Corporation (JP)

( * ) Notice: Subject to any disclaimer, the term of this patent is extended or adjusted under 35 U.S.C. 154(b) by 387 days.

(21) Appl. No.: 13/037,421

(22) Filed: Mar. 1, 2011

(65) Prior Publication Data

US 2011/0221732 A1 Sep. 15, 2011

(30) Foreign Application Priority Data

Mar. 12, 2010 (JP) ..... 2010-055578

(51) Int. Cl.
*G09G 3/36* (2006.01)

(52) U.S. Cl.
USPC ..... 345/89; 345/690

(58) Field of Classification Search
USPC ..... 345/89, 204, 211, 214, 690–693
See application file for complete search history.

(56) References Cited

U.S. PATENT DOCUMENTS 8,411,005 B2 * 4/2013 Park et al. ..... 345/90

FOREIGN PATENT DOCUMENTS

| | | | |
|---|---|---|---|
| JP | 2006-525546 | A | 11/2006 |
| JP | 2007-206267 | | 8/2007 |
| WO | WO-2004-100121 | A1 | 11/2004 |

* cited by examiner

*Primary Examiner* — Abbas Abdulselam
(74) *Attorney, Agent, or Firm* — Harness, Dickey & Pierce, P.L.C.

(57) ABSTRACT

An electro-optical device includes a display unit that includes a plurality of arranged pixels and a control unit that drives the display unit. When a part or the entirety of the display unit is displayed in a single gradation, the control unit performs a first elimination operation of selectively driving a first pixel group including the pixels displayed in gradations other than a first gradation to change the pixels included in the first pixel group to the first gradation, and a second elimination operation of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

15 Claims, 12 Drawing Sheets

(a) EXPANSION

P4 = P1 OR P3 OR P4 OR P5 OR P7

(b) CONTRACTION

P4 = P1 AND P3 AND P4 AND P5 AND P7

INVERSION

EXPANSION

CONTRACTION

XOR

INVERSION

S101

S102

S103

S201

S202

S203

ELECTRO-OPTICAL DEVICE, METHOD OF DRIVING ELECTRO-OPTICAL DEVICE, CONTROL CIRCUIT OF ELECTRO-OPTICAL DEVICE, AND ELECTRONIC APPARATUS

BACKGROUND

1. Technical Field

The present invention relates to an electro-optical device, a method of driving the electro-optical device, a control circuit of the electro-optical device, and an electronic apparatus.

2. Related Art

An electro-optical device using a memory-property display element such as an electrophoretic element and an electronic powder-particle element has been known. In such a kind of electro-optical device, it was possible to use a driving method using a memory property of the display element. For example, in a driving method described in JP-A-2007-206267, when the entire face of a display unit is switched to white display, only black-displayed pixels in the previous image are driven to be switched to the white display to prevent an afterimage.

However, when the all white display is performed using the method of selectively driving only the black-displayed pixels of the display unit, there is a problem that elimination in the vicinity of an outline of the black-displayed area is not sufficiently performed and an afterimage may be generated.

SUMMARY

An advantage of some aspects of the invention is to provide an electro-optical device capable of obtaining high-quality display with a reduced afterimage, a driving method, and a control circuit thereof.

According to an aspect of the invention, there is provided an electro-optical device including: a display unit that includes an electro-optical material layer interposed between a pair of substrates and a plurality of arranged pixels; and a control unit that controls driving of the display unit, wherein when a part or the entirety of the display unit is displayed in a single gradation, the control unit performs a first elimination operation of selectively driving a first pixel group including the pixels displayed in gradations other than a first gradation to change the pixels included in the first pixel group to the first gradation, and a second elimination operation of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

With such a configuration, in addition to the first elimination operation of selectively driving only the first pixel group displayed in a gradation other than the first gradation, the second elimination operation of re-eliminating only the part corresponding to the vicinity of the outline of the area formed of the first pixel group is provided, and thus it is possible to reliably eliminate an afterimage caused by the selective elimination of the area formed of the first pixel group. Accordingly, it is possible to obtain high-quality display with a reduced afterimage.

In the electro-optical device, it is preferable that the second pixel group gathers sets of two pixels adjacent to each other within the outline of the area formed of the first pixel group interposed therebetween.

With such a configuration, the area including the afterimage generated when selectively eliminating the area formed of the first pixel group is eliminated by the second elimination operation, and thus it is possible to reliably eliminate the afterimage.

According to another aspect of the invention, there is provided an electro-optical device including: a display unit that includes an electro-optical material layer interposed between a pair of substrates and a plurality of arranged pixels; and a control unit that drives the display unit, wherein when a part or the entirety of the display unit is displayed in a single gradation, the control unit performs a first elimination operation of selectively driving a first pixel group including the pixels displayed in gradations other than a first gradation to change the pixels included in the first pixel group to the first gradation, and a second elimination operation of selectively driving a second pixel group including the pixels included in the first pixel group and the pixels provided adjacent to the area formed of the first pixel group and surrounding the area to change the pixels included in the second pixel group to the first gradation.

With such a configuration, in addition to the first elimination operation of selectively driving only the first pixel group displayed in a gradation other than the first gradation, the second elimination operation of re-eliminating the part including slightly outside of the outline of the area formed of the first pixel group is provided, and thus it is possible to reliably eliminate the afterimage generated by the selective elimination of the area formed of the first pixel group. Accordingly, it is possible to obtain high-quality display with a reduced afterimage.

In the electro-optical device, it is preferable that the second pixel group is an area expanding the area formed of the first pixel group outward by one pixel.

With such a configuration, the area including the afterimage generated when selectively eliminating the area formed of the first pixel group is eliminated by the second elimination operation, and thus it is possible to reliably eliminate the afterimage.

In the electro-optical device, it is preferable that the display unit is provided with a plurality of scanning lines and a plurality of data lines extending in an intersection direction, and the plurality of pixels are provided at positions corresponding to the intersections of the plurality of scanning lines and the plurality of data lines, and that when a period of sequentially selecting the plurality of scanning lines once is one frame, the control unit performs the first elimination operation over a plurality of frames and performs the second elimination operation with a number of frames smaller than the number of frames of the first elimination operation.

With such a configuration, the time of performing the first and second elimination operation is adjusted in a unit of frame, and thus it is possible to set the performing time (the driving time of the electro-optical material layer) necessary and sufficient for the elimination of the afterimage and to reliably eliminate the afterimage. Since the second elimination operation is short, it is possible to eliminate the afterimage while avoiding the problem of excessive writing or current balance caused by performing the second elimination operation.

In the electro-optical device, it is preferable that voltage applied to the electro-optical material layer of the pixels in the second elimination operation is lower than voltage applied to the electro-optical material layer of the pixels in the first elimination operation.

Even in this configuration, it is possible to obtain the same operation and effect as the above-described adjustment in the same number of frames.

According to still another aspect of the invention, there is provided a method of driving an electro-optical device provided with a display unit including an electro-optical material layer interposed between a pair of substrates and a plurality of arranged pixels, wherein a step of displaying a part or the entirety of the display unit in a single gradation includes a first elimination step of selectively driving a first pixel group including the pixels displayed in gradations other than a first gradation to change the pixels included in the first pixel group to the first gradation, and a second elimination step of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

According to the driving method, in addition to the first elimination operation of selectively driving only the first pixel group displayed in a gradation other than the first gradation, the second elimination operation of re-eliminating only the part corresponding to the vicinity of the outline of the area formed of the first pixel group is provided, and thus it is possible to reliably eliminate the afterimage generated by the selective elimination of the area formed of the first pixel group. Accordingly, it is possible to obtain high-quality display with a reduced afterimage.

According to still another aspect of the invention, there is provided a method of driving an electro-optical device provided with a display unit including an electro-optical material layer interposed between a pair of substrates and a plurality of arranged pixels, wherein a step of displaying a part or the entirety of the display unit in a single gradation includes a first elimination step of selectively driving a first pixel group including the pixels displayed in gradations other than a first gradation to change the pixels included in the first pixel group to the first gradation, and a second elimination step of selectively driving a second pixel group including the pixels included in the first pixel group and the pixels provided adjacent to the area formed of the first pixel group and surrounding the area to change the pixels included in the second pixel group to the first gradation.

According to the driving method, in addition to the first elimination operation of selectively driving only the first pixel group displayed in a gradation other than the first gradation, the second elimination operation of re-eliminating the part including slightly outside of the outline of the area formed of the first pixel group is provided, and thus it is possible to reliably eliminate the afterimage generated by the selective elimination of the area formed of the first pixel group. Accordingly, it is possible to obtain high-quality display with a reduced afterimage.

In the method of driving the electro-optical device, it is preferable that in the first elimination step, the same image signal is written to the pixels a plurality of times, and in the second elimination step, the number of writings to the pixels is smaller than the number of writings of the first elimination step.

According to the driving method, the time of performing the first and second elimination operation is adjusted in a unit of frame, and thus it is possible to set the performing time (the driving time of the electro-optical material layer) necessary and sufficient for the elimination of the afterimage and to reliably eliminate the afterimage. Since the second elimination operation is short, it is possible to eliminate the afterimage while avoiding a problem of excessive writing or current balance caused by performing the second elimination operation.

In the method of driving the electro-optical device, it is preferable that in the second elimination step, voltage applied to the electro-optical material of the pixels is lower than voltage applied to the electro-optical material layer of the pixels in the first elimination operation.

Even according to this driving method, it is possible to obtain the same operation and effect as the above-described adjustment in the number of frames.

According to another aspect of the invention, there is provided a control circuit of an electro-optical device provided with a display unit including an electro-optical material layer interposed between a pair of substrates and a plurality of arranged pixels, wherein when a part or the entirety of the display unit is displayed in a single gradation, the control circuit performs a first elimination operation of selectively driving a first pixel group including the pixels displayed in gradations other than a first gradation to change the pixels included in the first pixel group to the first gradation, and a second elimination operation of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

According to the control circuit of the electro-optical device, in addition to the first elimination operation of selectively driving only the first pixel group displayed in a gradation other than the first gradation, the second elimination operation of re-eliminating only the part corresponding to the vicinity of the outline of the area formed of the first pixel group is provided, and thus it is possible to reliably eliminate an afterimage caused by the selective elimination of the area formed of the first pixel group. Accordingly, it is possible to obtain a high-quality display with a reduced afterimage.

In the control circuit, it is preferable that the control unit includes an image signal generating circuit that generates an image signal transmitted to the display unit, wherein the image signal generating circuit has a first image processing circuit generating an image signal used in the first elimination operation and a second image processing circuit generating an image signal used in the second elimination operation, wherein the first image processing circuit has a circuit reversely outputting image data corresponding to the image displayed on the display unit, wherein the second image processing circuit includes a pixel data storing unit that stores process target pixel data and a plurality of pixel data adjacent to the process target pixel data of the image data, an expansion processing circuit that receives an input of the plurality of pixel data from the image data storing unit, and changes and outputs the process target pixel data to a value corresponding to the second gradation when even any one of the plurality of pixel data is a value corresponding to the second gradation other than the first gradation, a contraction processing circuit that receives an input of the plurality of pixel data from the image data storing unit, and changes and outputs the process target pixel data to a value corresponding to the first gradation when any one of the plurality of pixel data is a value corresponding to the first gradation, and a selection circuit that selectively outputs an inverted signal of the output signal of the expansion processing circuit, and an exclusive NOR value of the output signal of the expansion processing circuit and the output signal of the contraction processing circuit.

According to another aspect of the invention, there is provided a control circuit of an electro-optical device provided with a display unit including an electro-optical material layer interposed between a pair of substrates and a plurality of arranged pixels, wherein when a part or the entirety of the display unit is displayed in a single gradation, the control circuit performs a first elimination operation of selectively driving a first pixel group including the pixels displayed in gradations other than a first gradation to change the pixels included in the first pixel group to the first gradation, and a second elimination operation of selectively driving a second pixel group including the first pixel group and the pixels provided adjacent to an area formed of the first pixel group and surrounding the area to change the pixels included in the second pixel group to the first gradation.

According to the control circuit of the electro-optical device, in addition to the first elimination operation of selectively driving only the first pixel group displayed in a gradation other than the first gradation, the second elimination operation of re-eliminating the part including slightly outside of the outline of the area formed of the first pixel group is provided, and thus it is possible to reliably eliminate the afterimage generated by the selective elimination of the area formed of the first pixel group. Accordingly, it is possible to obtain high-quality display with a reduced afterimage.

In the control circuit, it is preferable that the control circuit includes an image signal generating circuit that generates an image signal transmitted to the display unit, wherein the image signal generating circuit has a first image processing circuit generating an image signal used in the first elimination operation and a second image processing circuit generating an image signal used in the second elimination operation, wherein the first image processing circuit has a circuit reversely outputting image data corresponding to the image displayed on the display unit, wherein the second image processing circuit includes a pixel data storing unit that stores process target pixel data and a plurality of pixel data adjacent to the process target pixel data of the image data, an expansion processing circuit that receives an input of the plurality of pixel data from the image data storing unit, and changes and outputs the process target pixel data to a value corresponding to the second gradation when even any one of the plurality of pixel data is a value corresponding to the second gradation other than the first gradation, and a circuit that reversely outputs the output signal of the expansion processing circuit.

According to another aspect of the invention, there is provided an electronic apparatus that includes the electro-optical device described above.

With such configuration, it is possible to provide the electronic apparatus including display means with excellent display quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
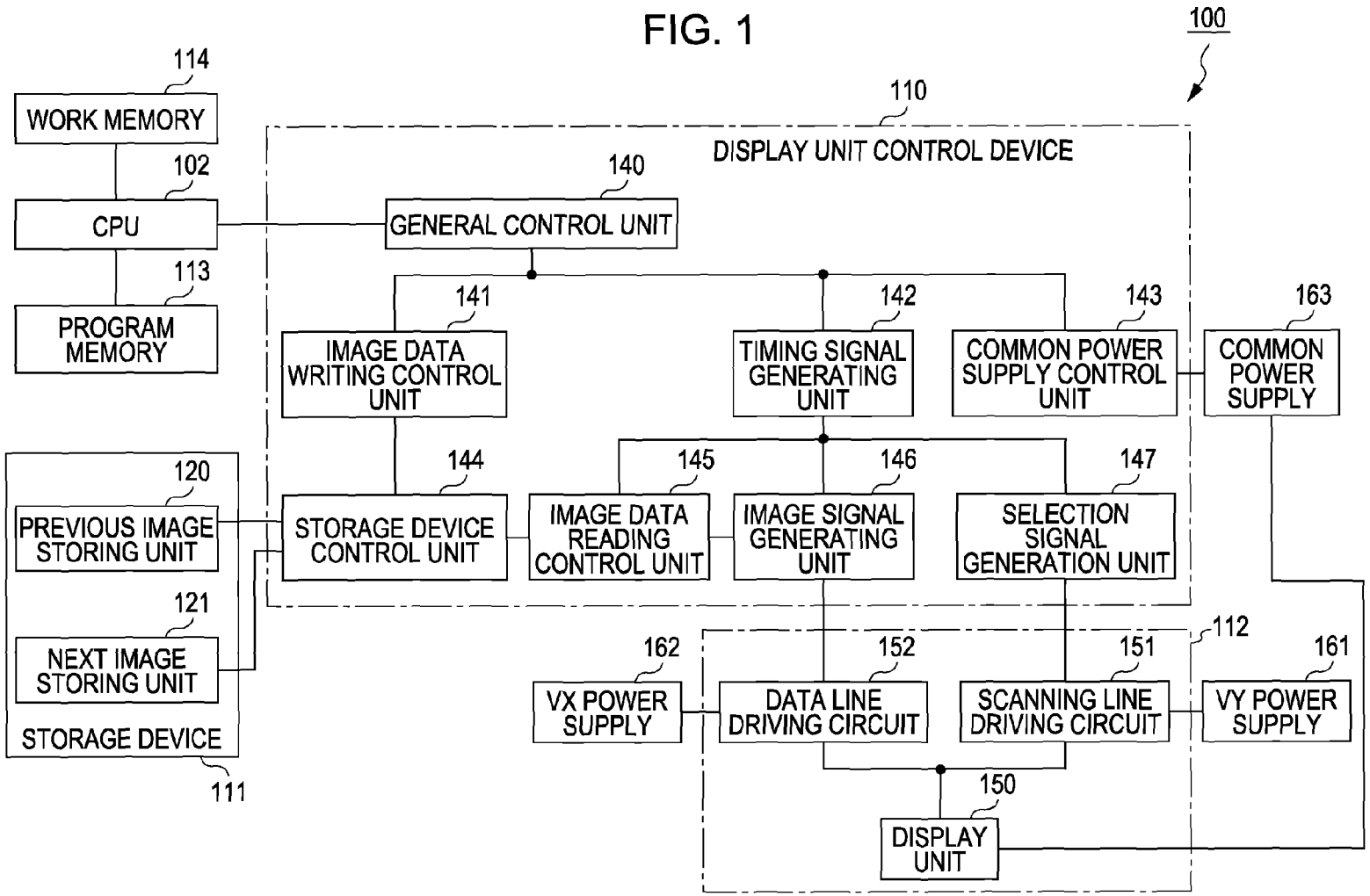
FIG. 1 is a functional block diagram illustrating an electro-optical device according to a first embodiment.

Hereinafter, an electro-optical device of the invention will be described with reference to the drawings.

The scope of the invention of the invention is not limited to the following embodiments, and may be arbitrarily modified within the scope of the technical spirit of the invention. In the drawings, the scale or numbers or the like may be different for ease of comprehension of the configurations.

First Embodiment

Figure 2:
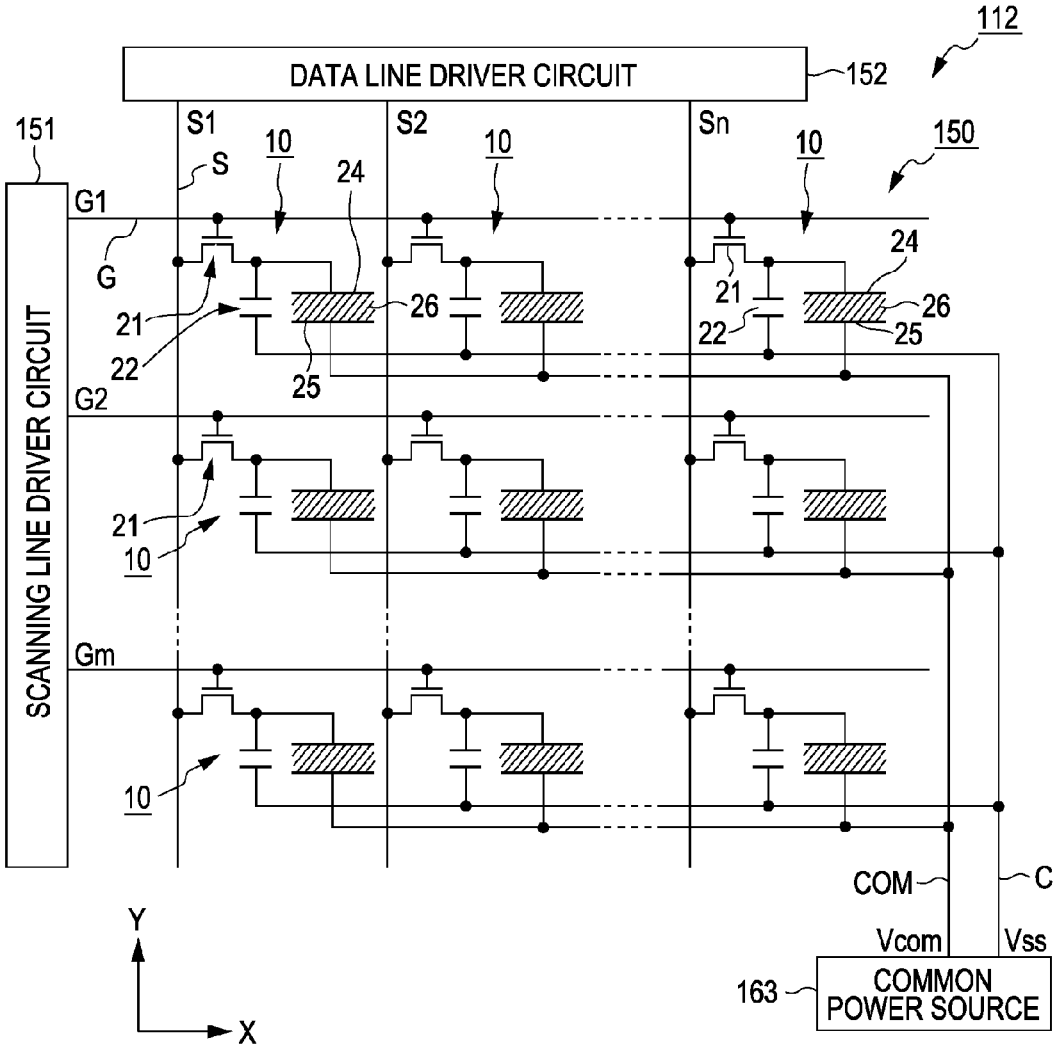
FIG. 2 is a diagram illustrating a circuit configuration of an electro-optical panel.
Figure 3A:
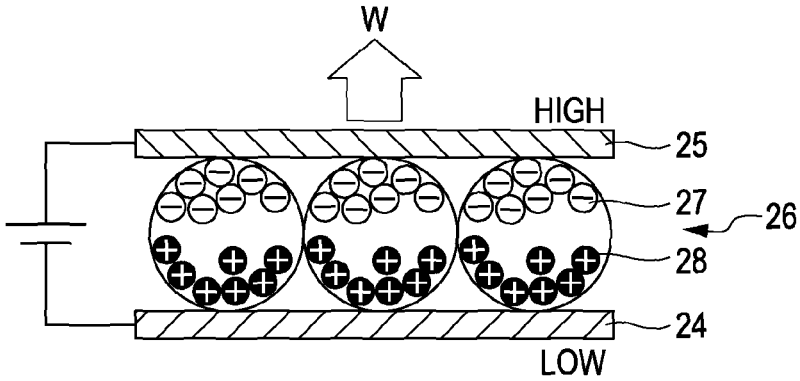
FIG. 3A and FIG. 3B are diagrams illustrating an operation of an electrophoretic element.
Figure 3B:
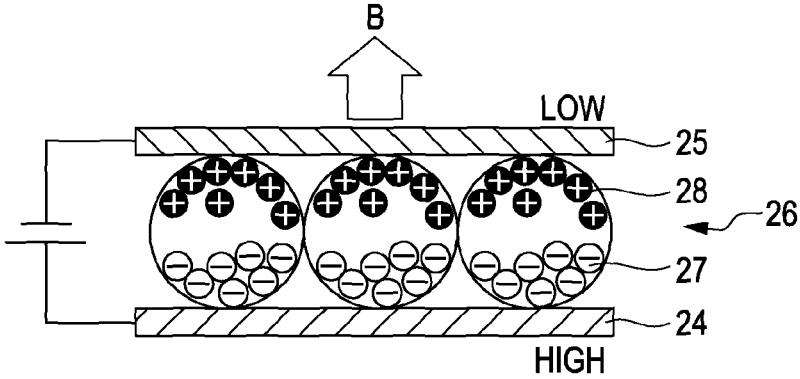

FIG. 1 is a functional block diagram of an electro-optical device according to a first embodiment of the invention. FIG. 2 is a diagram illustrating a circuit configuration of an electro-optical panel. FIG. 3A and FIG. 3B are diagrams illustrating an operation of an electrophoretic element.

As shown in FIG. 1, the electro-optical device 100 includes a CPU (Central Processing Unit: control unit) 102, a display unit control device 110, a storage device 111, an electro-optical panel 112, a program memory 113, a work memory 114, a VY power supply 161, a VX power supply 162, and a common power supply 163.

The CPU 102 is connected to the display unit control device 110, the program memory 113, and the work memory 114. The display unit control device 110 is connected to the storage device 111, the electro-optical panel 112, and the common power supply 163. The electro-optical panel 112 is connected to the VY power supply 161, the VX power supply 162, and the common power supply 163.

The CPU 102 reads various programs and data such as basic control programs and application programs stored in the program memory 113, and develops executes the programs and data in a work area provided in the work memory 114, thereby controlling units of the electro-optical device 100.

For example, when image data supplied from a superior device (not shown) is displayed on the electro-optical panel 112, the CPU 102 generates a command for controlling the electro-optical panel 112 on the basis of a control signal input from the superior device, and outputs the command to the display unit control device 110 with the image data.

The program memory 113 is, for example, a ROM (Read Only Memory) storing various programs, and the work memory 114 is a RAM (Random Access Memory) constituting a work area of the CPU 102. The program memory 113 and the work memory 114 may be included in the storage device 111. Alternatively, the program memory 113 and the work memory 114 may be built in the CPU 102.

The display unit control device 110 (control unit or control circuit) includes a general control unit 140, an image data writing control unit 141, a timing signal generating unit 142, a common power supply control unit 143, a storage device control unit 144, an image data reading control unit 145, an image signal generating unit 146, and a selection signal generating unit 147.

The general control unit 140 is connected to the image data writing control unit 141, the timing signal generating unit 142, and the common power supply control unit 143. The image data writing control unit 141 is connected to the storage device control unit 144. The timing signal generating unit 142 is connected to the image data reading control unit 145, the image signal generating unit 146, and the selection signal generating unit 147. The common power control unit 143 is connected to the common power supply 163.

In the display unit control device 110, the general control unit 140 is connected to the CPU 102, the image signal generating unit 146 and the selection signal generating unit 147 are connected to the electro-optical panel 112, and the storage device control unit 144 is connected to the storage unit 111.

The entire storage device 111 is formed of RAMs, and includes a previous image storing unit 120 and a next image storing unit 121. The previous image storing unit 120 is a storage area storing image data (image data corresponding to the currently displayed image) after display on the electro-optical panel 112, and the next image storing unit 121 is a storage area storing image data (image data corresponding to the updated image) displayed from the current time on the electro-optical panel 112.

All of the previous image storing unit 120 and the next image storing unit 121 are connected to the storage device control unit 144 of the display unit control device 110, and the display unit control device 110 performs reading and writing of image data from and to the storage device 111 through the storage device control unit 144.

The electro-optical panel 112 includes a display unit 150 provided with a memory-property display element such as an electrophoretic element and a cholesteric liquid crystal element, and a scanning line driving circuit 151 and a data line driving circuit 152 connected to the display unit 150. The display unit 150 is connected to the common power supply 163. The scanning line driving circuit 151 is connected to the VY power supply 161, and the selection signal generating unit 147 of the display unit control device 110. The data line driving circuit 152 is connected to the VX power supply 162 and the image signal generating unit 146 of the display unit control device 110.

As shown in FIG. 2, the display unit 150 of the electro-optical panel 112 is provided with a plurality of scanning lines G (G1, G2, . . . , Gm) extending in the X-axis direction and a plurality of data lines S (S1, S2, . . . , Sn) extending in the Y-axis direction (perpendicular to the X axis). Pixels 10 are formed corresponding to intersections of the scanning lines G and the data lines S. The pixels 10 are arranged in matrix in which m pixels 10 are arranged along the Y-axis direction and n pixels 10 are arranged along the X-axis direction, and the pixels 10 are connected to the scanning lines G and the data lines S. The display unit 150 is provided with a common electrode line COM extending from the common power supply 163 and a capacitance line C.

The pixel 10 is provided with a selection transistor 21 as a pixel switching element, a storage capacitor 22, a pixel electrode 24, a common electrode 25, and an electro-optical material layer 26.

The selection transistor 21 is formed of an N-MOS (Negative-channel Metal Oxide Semiconductor) TFT. A gate of the selection transistor 21 is connected to the scanning line G, a source is connected to the data line S, and a drain is connected to one electrode of the storage capacitor 22 and the pixel electrode 24.

The storage capacitor 22 is formed of a pair of electrodes opposed with a dielectric film interposed therebetween. One electrode of the storage capacitor 22 is connected to the drain of the selection transistor 21, and the other electrode is connected to the capacitance line C. The image signal written through the selection transistor 21 can be stored by the storage capacitor 22 only for a predetermined period.

The electro-optical material layer 26 is formed of an electrophoretic element, a cholesteric liquid crystal element, an electronic power-particle element. An example of the electrophoretic element is an element formed by arranging microcapsules in which electrophoretic particles and dispersion materials are sealed, and an element formed by sealing electrophoretic particles and dispersion materials in a space partitioned by a partition wall and a substrate.

The scanning line driving circuit 151 is connected to the scanning lines G formed in the display unit 150, and is connected to the pixels 10 of the corresponding rows through the scanning lines G. The scanning line driving circuit 151 supplies selection signals to the scanning lines G1, G2, . . . , Gm in pulse form on the basis of timing signals supplied from the timing signal generating unit 142 shown in FIG. 1 through the selection signal generating unit 147, to sequentially make the scanning lines g one by one to a selection state. The selection state is a state where the selection transistor 21 connected to the scanning line G is turned on.

The data line driving circuit 152 is connected to the data lines S formed in the display unit 150, and is connected to the pixels 10 of the corresponding rows through the data lines S. The data line driving circuit 152 supplies image signals generated by the image signal generating unit 146 to the data lines S1, S2, . . . , Sn on the basis of timing signals supplied from the timing signal generating unit 142 through the image signal generating unit 146.

In the operation description to be described later, the image signal takes binary potential of high level potential VH (e.g., 15 V) or low level potential VL (e.g., 0 V or −15 V). In the embodiment, a high level image signal (potential VH) corresponding to pixel data "1" is supplied to the pixels 10 on which black (first display state) is to be displayed, a low level image signal (potential VL) corresponding to pixel data "0" is supplied to the pixels 10 on which white (second display state) is to be displayed.

Potential Vcom is supplied from the common power supply 163 to the common electrode 25, and potential Vss is supplied from the common power supply 163 to the capacitance line C.

However, in the operation description to be described later, for brevity of description, the potential Vcom of the common electrode 25 takes the binary potential of low-level potential VL (e.g., 0 V or −15 V) or high level potential VH (e.g., 15 V). The potential Vss of the capacitance line C is fixed to reference potential GND (e.g., 0 V).

As described above, various configurations may be applied to the electro-optical material layer 26 of the embodiment. However, in the following description, it is assumed that the electro-optical material layer 26 is an electrophoretic element for ease of understanding the invention. FIG. 3A and FIG. 3B are diagrams illustrating an operation of the electrophoretic element, FIG. 3A shows a case of displaying white on the pixel, and FIG. 3B shows a case of displaying black on the pixel.

In the case of displaying white shown in FIG. 3A, the common electrode 25 is kept in relatively high potential, and the pixel electrode 24 is kept in relatively low potential. Accordingly, negatively charged white particles 27 can be drawn to the common electrode 25, and positively charged black particles 28 can be drawn to the pixel electrode 24. As a result, when viewing the pixel from the common electrode 25 that is a display side, white (W) is visible.

In the case of displaying black shown in FIG. 3B, the common electrode 25 is kept in relatively low potential, and the pixel electrode 24 is kept in relatively high potential. Accordingly, positively charged black particles 28 can be drawn to the common electrode 25, and negatively charged white particles 27 can be drawn to the pixel electrode 24. As a result, when viewing the pixel from the common electrode 25, black (B) is visible.

In the embodiment, the active matrix electro-optical panel 112 provided with the scanning line driving circuit 151 and the data line driving circuit 152 is described, but the electro-optical panel 112 may be a passive matrix or segment driving electro-optical panel. Another active matrix may be employed. For example, a 2T1C (2 transistors and 1 capacitor) type may be employed in which a selection transistor, a driving transistor, and a storage capacitor are provided for each pixel, and a drain of the selection transistor and one electrode of the storage capacitor are connected to a gate of the driving transistor. Alternatively, an SRAM type provided with a latch circuit connected to the drain of the selection transistor may be employed, and a type of controlling connection of the pixel electrode and the control line by an output of the latch circuit may be employed. Even in any type, when the selection transistor is selected by the scanning line, the image signal from the data line is supplied to the pixel circuit through the selection transistor, and the pixel electrode becomes a potential corresponding to the image signal.

Even in such a type, it is possible to selectively drive a part of the pixels 10 of the display unit 150, and to display the image by applying the driving method to be described later.

Figure 4:
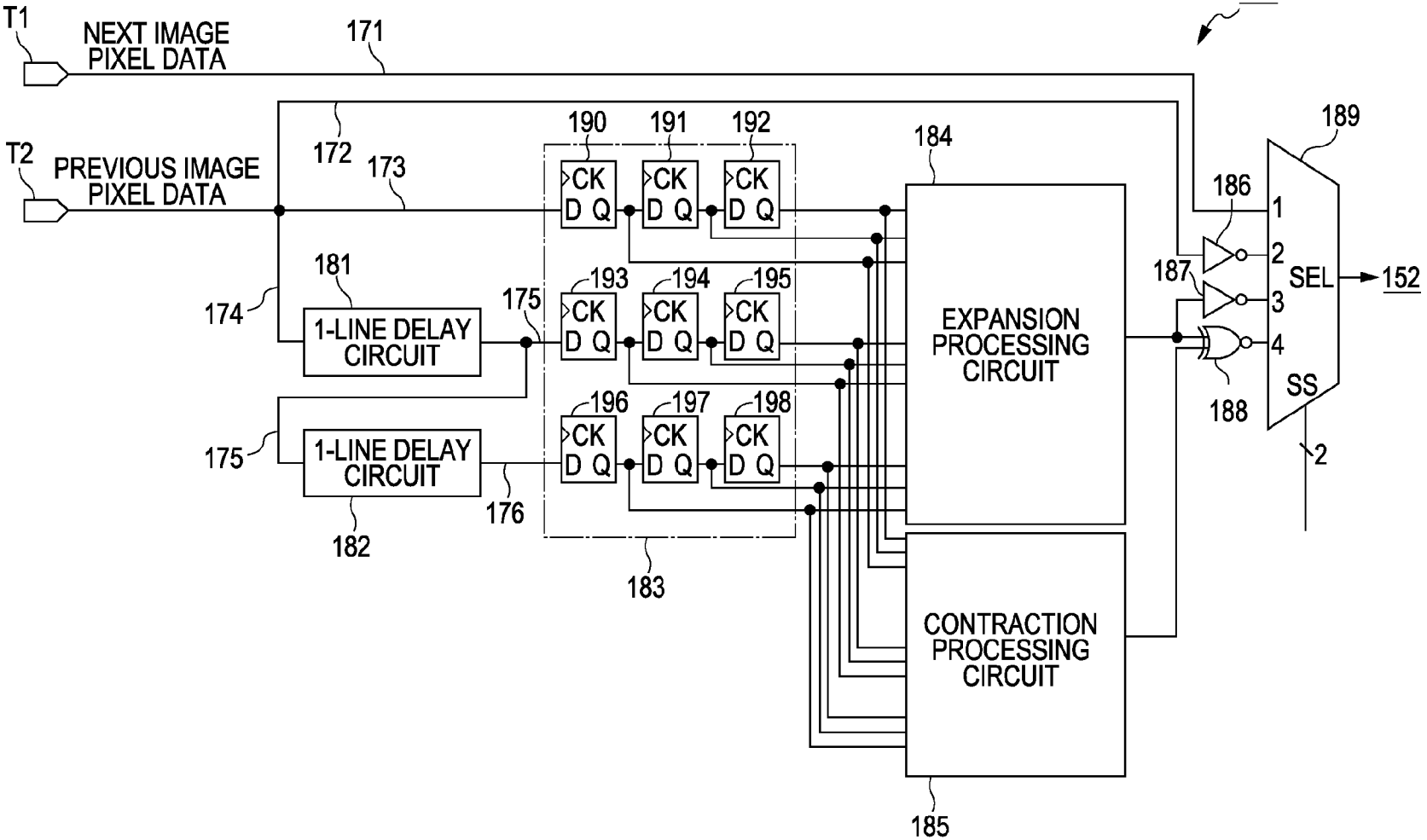
FIG. 4 is a functional block diagram illustrating a detailed configuration of an image signal generating unit.

FIG. 4 is a functional block diagram illustrating a detailed configuration of the image signal generating unit 146 (image signal generating circuit) shown in FIG. 1.

The image signal generating unit 146 includes 1-line delay circuits 181 and 182, a pixel data storing unit 183, an expansion processing circuit 184, a contraction processing circuit 185, inverter circuits (NOT circuit) 186 and 187, a NXOR circuit 188, and a selection circuit 189 (selector).

"Next image pixel data" and "previous image pixel data" are input from the image data reading control unit 145 to the image signal generating unit 146. The "next image pixel data" is pixel data constituting the image data (next image data) stored in the next image storing unit 121 shown in FIG. 1. The "previous image pixel data" is pixel data constituting the image data (previous image data) stored in the previous image storing unit 120.

The image data reading control unit 145 reads the next image data from the next image storing unit 121 through the storage device control unit 144, and reads the previous image data from the previous image storing unit 120. Each of the corresponding pixel data (pixel data of the same address) of the next image data and the previous image data is sequentially supplied to terminals T1 and T2.

A line 171 is connected to the terminal T1 to which the "next image pixel data" is supplied. The line 171 is connected to one input terminal of the selection circuit 189. The selection circuit 189 is a selector with 4 inputs and 1 output, selects one signal from four input signals by an input of a 2-bit control signal, and outputs the signal to the data line driving circuit 152.

Three lines 172 to 174 are connected to the terminal T2 to which the "previous image pixel data" is supplied. The line 172 is connected to an input terminal of the NOT circuit 186, and an output terminal of the NOT circuit 186 is connected to one terminal of the input terminals of the selection circuit 189. The line 173 is connected to the pixel data storing unit 183 (D input of the data storing circuit 190). The line 174 is connected to an input terminal of the 1-line delay circuit 181.

The pixel data storing unit 183 includes nine data storing circuits 190 to 198 provided in matrix of 3 rows and 3 columns. In the embodiment, each of the data storing circuits 190 to 198 is a D flip-flop. In the pixel data storing unit 183, D inputs of the data storing circuits 190, 193, and 196 belonging to the first row are input terminals (3 inputs), and Q outputs of nine data storing circuits 190 to 198 are output terminals (9 outputs).

The data storing circuits 190 to 198 are not limited to the D flip-flop, and other circuits capable of temporarily storing the pixel data may be used.

The 1-line delay circuits 181 and 182 a circuit storing the pixel data supplied through the input terminal during a predetermined period (selection period of the scanning line G), and then outputting the pixel data from the output terminal.

The output terminal of the 1-line delay circuit 181, the input terminal of which is connected to the line 174, is connected to the pixel data storing unit 183 (D input of the data storing circuit 193) and the input terminal of the 1 -line delay circuit 182 through the line 175. The output terminal of the 1-line delay circuit 182 is connected to the pixel data storing unit 183 (D input of data storing circuit 196) through the line 176.

Accordingly, the pixel data, the timing of which is delayed by one line by the 1-line delay circuit 181, is input to the 1-line delay circuit 182, the timing of the pixel data is further delayed by one line by the 1-line delay circuit 182, and the pixel data is output.

A specific operation is as follows.

First, the "previous pixel data" input to the terminal T2 is directly input to the data storing circuit 190 of the pixel data storing unit 183 through the line 173 at a predetermined timing, and is input and stored in the 1 -line delay circuit 181. Thereafter, at a timing when a period corresponding to the selection period of the scanning line G elapses, the data is input from the 1-line delay circuit 181 to the data storing circuit 193 of the pixel data storing circuit 183 through the line 175, and is input to and stored in the 1-line delay circuit 182. Further thereafter, at a timing when a period corresponding to the selection period of the scanning line G, the data is input from the 1-line delay circuit 182 to the data storing circuit 196 of the pixel data storing unit 183 through the line 176. Accordingly, three continuous pixel data belonging to the same row of the previous image data are simultaneously input to three input terminals of the pixel data storing unit 183.

The data storing circuits of the rows of the pixel data storing unit 183 are connected in series in the rows. That is, the Q output of the data storing circuit 190 of the first row is connected to the D input of the data storing circuit 191 of the second row, and the Q output of the data storing circuit 191 of the second row is connected to the D input of the data storing circuit 192 of the third row. Similarly, the Q output of the data storing circuit 193 is connected to the D input of the data storing circuit 194, and the Q output of the data storing circuit 194 is connected to the D input of the data storing circuit 195. In addition, the Q output of the data storing circuit 196 is connected to the D input of the data storing circuit 197, and the Q output of the data storing circuit 197 is connected to the D input of the data storing circuit 198.

With the configuration, the pixel data input to the data storing circuits 190, 193, and 196 are transmitted to the data storing circuits 191, 194, and 197 after one stage in synchronization with the next clock, and are transmitted to the data storing circuits 192, 195, and 198 after one further stage in synchronization with the further next clock. As a result, the pixel data corresponding to nine pixels provided in 3×3 matrix of the previous image data are sequentially stored in the pixel data storing unit 183.

Nine pixel data stored in the pixel data storing unit 183 are output to the expansion processing circuit 184 and the contraction processing circuit 185 connected to the output terminals (the Q outputs of nine data storing circuits 190 to 196) of the pixel data storing unit 183.

The expansion processing circuit 184 is a circuit receiving the inputs of nine pixel data output from the pixel data storing unit 183, and outputting a result of a logical OR operation using such pixel data.

The contraction processing circuit 185 is a circuit of receiving the inputs of nine pixel data output from the pixel data storing unit 183, and outputting a result of a logical AND operation using such pixel data.

Figure 5:
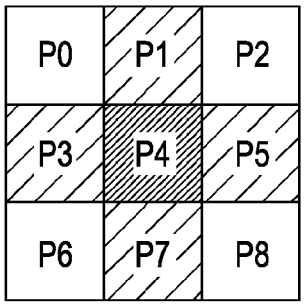
FIG. 5 is a diagram illustrating an operational expression used in an expansion processing circuit and a contraction processing circuit.

FIG. 5 is a diagram illustrating an example of an operational expression used in the expansion processing circuit 184 and the contraction processing circuit 185. The pixel data P0 to P8 shown in FIG. 5 correspond to the stored data of the data storing circuits 190 to 198.

The expansion processing circuit 184 and the contraction processing circuit 185 considers the center pixel data P4 (the stored data of the data storing circuit 194) as process target pixel data, and performs an operation using the pixel data P1, P3, P5, and P7 therearound and the operational expression exemplified in the expressions (a) and (b) shown in FIG. 5.

In the expansion process shown in the expression (a) of FIG. 5, as the process target pixel data P4, an operation result of logical OR of the pixel data P4 and the pixel data P1, P3, P5, and P7 adjacent thereto is output. That is, when even any one of P1, P3, P4, P5, and P7 is "1" (image data corresponding to black display), "1" is output as the pixel data P4. In the other cases, "0" is output as the pixel data P4.

According to this process, pixel data of pixels provided adjacent to image components of the black display of pixels that are originally white display are changed from "0" to "1". Accordingly, the pixel data of one frame passes through the expansion processing circuit 184, and thus it is possible to obtain image data in which the outline of the image components of the black display is expanded outward from the original image data.

In the contraction process shown in the expression (b) of FIG. 5, as the process target pixel data P4, an operation result of logical AND of the pixel data P4 and the pixel data P1, P3, P5, and P7 adjacent thereto is output. That is, when even any one of P1, P3, P4, P5, and P7 is "0" (image data corresponding to white display), "0" is output as the pixel data P4. In the other cases, "1" is output.

According to this process, pixel data of pixels provided adjacent to image components of the black display of pixels that are originally set to white display are changed from "1" to "0". Accordingly, the pixel data of one frame passes through the contraction processing circuit 185, and thus it is possible to obtain image data in which the outline of the image components of the black display is contracted inward from the original image data.

In the above-description, the pixel data P1, P3, P5, and P7 adjacent up, down, left, and right to the pixel data P4 are used, but the pixel data P0, P2, P6, and P8 obliquely adjacent to the pixel data P4 may be added to the operational expression. In this case, when even any one of eight pixel data P0 to P3 and P5 to P8 surrounding the process target pixel data P4 is "1" (black display), the expansion processing circuit 184 outputs "1" as the process target pixel data P4. In the other cases, the expansion processing circuit 184 outputs "0". When even any one of eight pixel data P0 to P3 and P5 to P8 surrounding the process target pixel data P4 is "0" (white display), the contraction processing circuit 185 outputs "0" as the process target pixel data P4. In the other cases, the contraction processing circuit 185 outputs "0".

Alternatively, the operation may be performed using only the obliquely provided pixel data P0, P2, P6, and P8, instead of the pixel data P1, P3, P5, and P7 provided up, down, left, and right of the process target pixel data P4. According to cases, the operation may be performed using the pixel data provided in a specific direction with respect to the process target pixel data P4. For example, the operation may be performed using only the pixel data P3 and P5 provided left and right of the pixel data P4, and the operation may be performed using only the pixel data P1 and P7 provided up and down.

The output terminal of the expansion processing circuit 184 is connected to the input terminal of the NOT circuit 187, and the output terminal of the NOT circuit 187 is connected to one of the input terminals of the selection circuits 189. The output terminal of the expansion processing circuit 184 and the output terminal of the contraction processing circuit 185 are connected to the input terminals of the NXOR circuit 188, and the output terminal of the NXOR circuit 188 is connected to one input terminal of the selection circuit 189.

FIG. 6A to FIG. 6F are diagrams illustrating images generated in the image signal generating unit 146.

Figure 6A:
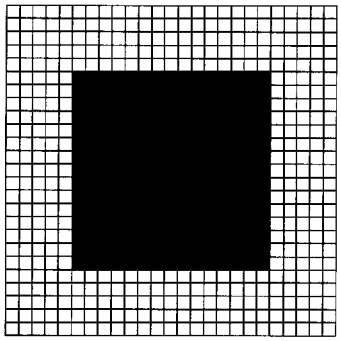
FIG. 6A to FIG. 6F are diagrams illustrating images generated in an image signal generating unit.

The image in which a black square is represented at the center shown in FIG. 6A is an example of the previous image data displayed on the electro-optical panel 112 in advance. The pixel data constituting the previous image data shown in FIG. 6A are sequentially supplied to the terminal T2 of the image signal generating unit 146.

Figure 6B:
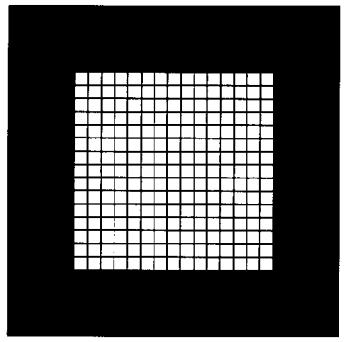

FIG. 6B is an image generated when the input 2 (terminal connected to the NOT circuit 186) is selected in the selection circuit 189. The pixel data supplied through the terminal 2 is inverted by the NOT circuit 186, and is input to the selection circuit 189. As a result, the image formed by the image signal output from the selection circuit 189 becomes an inverted image in which a white square is represented at the center of the black background shown in FIG. 6B.

Figure 6C:
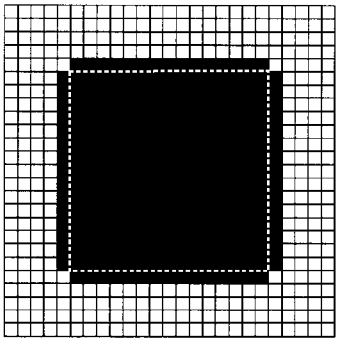

FIG. 6C is an image output from the expansion processing circuit 184. As described above, it is possible to obtain an image expanded outward by one pixel from the sides of the black square shown in FIG. 6A by passing through the expansion processing circuit 184. When the input 3 (terminal connected to the NOT circuit 187) is selected in the selection circuit 189, an image output from the selection circuit 189 is an inverted image of the image shown in FIG. 6C.

Figure 6D:
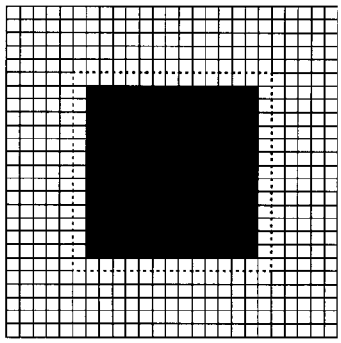
Figure 6E:
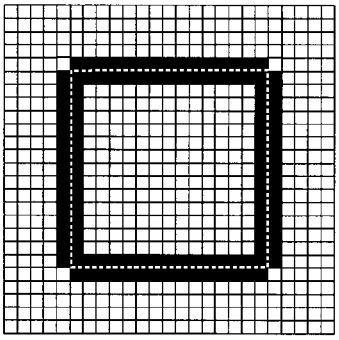

FIG. 6D is an image output from the contraction processing circuit 185. As described above, it is possible to obtain an image contracted inward by one pixel from the sides of the black square shown in FIG. 6A by passing through the contraction processing circuit 185.

When the input 4 (terminal connected to the NXOR circuit) is selected in the selection circuit 189, an image output from the selection circuit 189 is an exclusive NOR (NXOR) such as the expanded image shown in FIG. 6C and the contracted image shown in FIG. 6D.

Figure 6F:
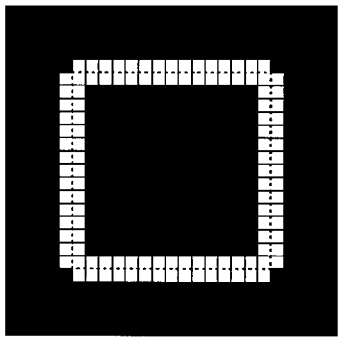

In FIG. 4, the output (the expanded image in FIG. 6C) of the expansion processing circuit 184 and the output (the contracted image in FIG. 6D) of the contraction processing circuit 185 are input to the NXOR circuit 188. In the NXOR circuit 188, the exclusive OR (XOR) of the expanded image and the contracted image is operated (FIG. 6E), and inverts the operation result. Accordingly, as shown in FIG. 6F, it is possible to obtain an image in which a black background and a white frame are represented. The image shown in FIG. 6F is an image in which two pixels with a boundary (indicated by a dotted line in FIG. 6F) of the black image component of the previous image data shown in FIG. 6A interposed therebetween are selectively displayed with white, and the others are displayed with black.

Driving Method

Next, a method of driving the electro-optical device 100 will be described with reference to FIG. 7 to FIG. 8D.

Figure 7:
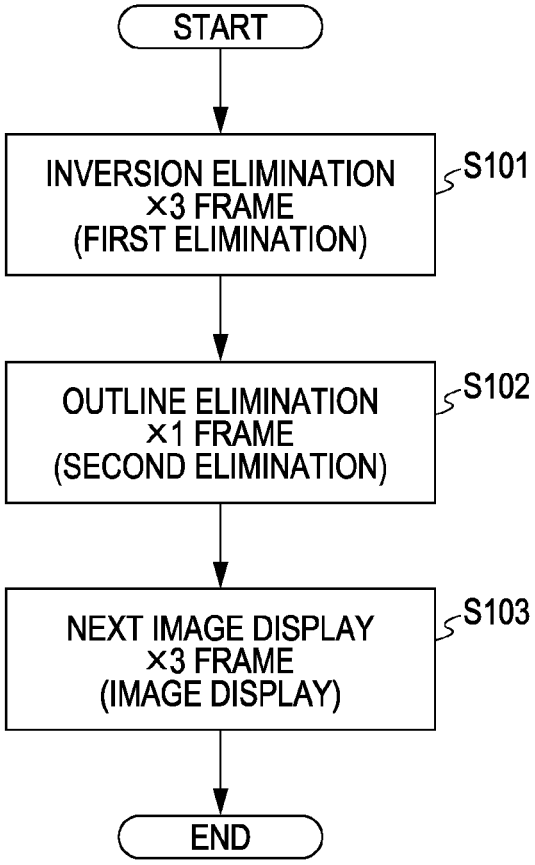
FIG. 7 is a flowchart illustrating a method of driving the electro-optical device according to the first embodiment.

FIG. 7 is a flowchart illustrating a driving method of the first embodiment, and FIG. 8A to FIG. 8D are diagrams illustrating a form of transition of the display unit of the electro-optical panel with the image data used in the steps of FIG. 7.

The flowchart shown in FIG. 7 shows a series of flow when updating the display image of the electro-optical device 100, and includes a first elimination step S101, a second elimination step S102, and an image display step S103. The upper parts of FIG. 8B to FIG. 8D are diagrams illustrating the display state of the display unit 150 corresponding to the execution result of the steps S101 to S103, and the lower parts of FIG. 8B to FIG. 8D are diagrams illustrating the image data D1 to D3 used in the steps S101 to S103.

Figure 8A:
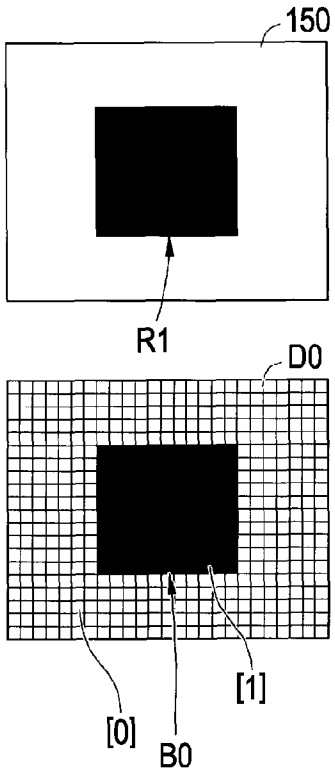
FIG. 8A to FIG. 8D are diagrams illustrating a form of transition of a display unit with image data.
Figure 8B:
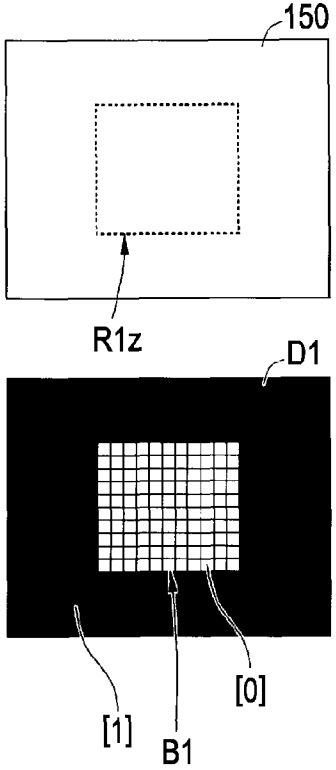
Figure 8C:
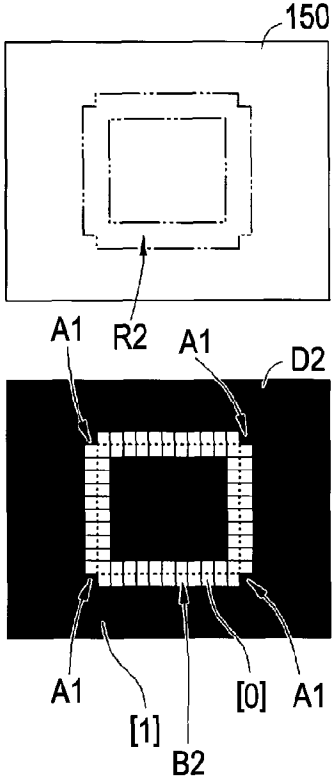

In the driving method of the embodiment, by performing the first elimination step S101 and the second elimination step S102, the entire face is displayed with white (first gradation) by eliminating the rectangular image of black (second gradation) from the display unit 150 shown in FIG. 8A. That is, white single gradation display is performed on the display unit 150. Thereafter, by performing the image display step S103, a black stripe-shaped image shown in FIG. 8D is displayed on the display unit 150.

In a case of updating the display of the electro-optical panel 112 by the driving method of the embodiment, first, the CPU 102 transmits a panel driving request including the image data (next image data) displayed at the next time to the display unit control device 110.

The general control unit 140 of the display unit control device 110 receiving the panel driving request outputs the received next image data (the image data D4 shown in FIG. 8D) to the image data writing control unit 141. The image data writing control unit 141 stores the received image data in the next image storing unit 121 of the storage device 111 through the storage device control unit 144. At this time, the image data D0 corresponding to FIG. 8A is stored in the previous image storing unit 120. Thereafter, the steps S101 to S103 that are a preset driving sequence are sequentially performed by the general control unit 140.

First, the general control unit 140 outputs a command for performing the first elimination step S101 to the timing signal generating unit 142 and the common power supply control unit 143 on the basis of the panel driving request.

In the first elimination Step S101, an inversion elimination operation of the previous image is performed over three frames. More specifically, the operation of displaying the inverted image of the previous image is repeatedly performed three times on the display unit 150 of the electro-optical panel 112.

The timing signal generating unit 142 outputs a command for reading the previous image data used in the first elimination step S101 from the previous image storing unit 120 of the storage device 111, to the image data reading control unit 145. The image data reading control unit 145 acquires the previous image data from the previous image storing unit 120 through the storage device control unit 144, and outputs the acquired previous image data to the image signal generating unit 146 one pixel by one pixel.

The image signal generating unit 146 is set to a mode of outputting the inverted image by the control signal input through the timing signal generating unit 142. That is, the control signal of selecting the input 2 (terminal connected to the NOT circuit 186) is input to a control terminal SS of the selection circuit 189. Accordingly, the pixel data input from the image data reading control unit 145 to the image signal generating unit 146 through the terminal T2 is inverted by the NOT circuit 186, and then is output from the selection circuit 189 to the data line driving circuit 152.

As described above, in the embodiment, the first image processing circuit of generating the image data used in the first elimination step S101 is the NOT circuit 186 shown in FIG. 4.

By the operation, the image signal corresponding to the image data D1 obtained by inverting the image data D0 is output from the selection circuit 189. The image signal generating unit 146 outputs the image signal to the data line driving circuit 152 with the timing signal.

In the first elimination step S101 according to the embodiment, only the pixels 10 belonging to an area R1 (the first pixel group) shown in FIG. 8A of the pixels 10 constituting the display unit 150 is operated to display white, to eliminate the image. For this reason, the low level potential VL (e.g., −15 V) is input as the image signal to the pixels 10 corresponding to the area B1 (the pixel data "0" represented by white) in the image data D1 shown in FIG. 8B. Meanwhile, the reference potential GND (e.g., 0 V) is input as the image signal to the pixels 10 corresponding to the pixel data "1" represented by black.

The selection signal generating unit 147 generates a selection signal necessary for image display under the control of the timing signal generating unit 142, and outputs the selection signal to the scanning line driving circuit 151 with the timing signal.

The common power supply control unit 143 outputs a command for supplying the reference potential GND (e.g., 0 V) to the common electrode 25, to the common power supply 163.

In the electro-optical panel 112, the image signal (the low level potential VL or the reference potential GND) based on the inverted image of the previous image is input to the pixel electrode 24 of the pixel 10 by the scanning line driving circuit 151 to which the selection signal is input and the data line driving circuit 152 to which the image signal is input. The reference potential GND is input to the common electrode 25.

Accordingly, in the pixel 10 belonging to the area R1 displayed with black on the previous pixel, the pixel electrode 24 is considered as the low level potential VL and becomes a relatively low potential with respect to the common electrode 25 (the reference potential GND), and thus the electro-optical material layer 26 (the electrophoretic element) is operated by the white display (see FIG. 3A). Meanwhile, in the pixels 10 other than the area R1, the reference potential GND is input to the pixel electrode 24, it becomes the same potential as the common electrode 25, and thus the electro-optical material layer 26 is not driven.

In the first elimination step S101 of the embodiment, the inversion elimination operation of the electro-optical panel 112 is repeatedly performed three times. The size of the storage capacitor 22 of the pixel 10 is limited, and generally, it is difficult to accumulate enough energy to sufficiently respond for the electro-optical material layer 26 in one charge. The input of the image signal to the pixel 10 using the same image data D1 is repeatedly performed three times, the driving time of the electro-optical material layer 26 is extended, and thus it is possible to obtain the display with a desired contrast.

In the electro-optical panel 112 according to the embodiment, the input of the image signal to the pixel 10 is performed by the scanning line driving circuit 151 and the data line driving circuit 152, a period of sequentially selecting all the scanning lines G once is considered as one frame (1-frame period). Accordingly, the inversion elimination operation is performed over 3 frames.

By the above-described first elimination step S101, the area R1 (the first pixel group) of the display unit 150 is displayed with white, and most of the entire display unit 150 is displayed with white as shown in FIG. 8B. However, when the black display area R1 is selectively changed to the white display in the same manner as the first elimination step S101, a gray line (an afterimage R1*z*) remains along the outline of the area R1. In the driving method of the embodiment, the afterimage R1*z* is eliminated by the subsequent second elimination step S102.

The second elimination step S102 is a step of eliminating the afterimage R1*z*, and the outline elimination operation of selectively eliminating the outline part of the previous image is performed only once (1 frame).

The general control unit 140 outputs a command for performing the second elimination step S102 to the timing signal generating unit 142 and the common power supply control unit 143.

The timing signal generating unit 142 outputs a command for reading the previous image data used in the second elimination step S102 from the previous image storing unit 120 of the storage device 111, to the image data reading control unit 145. The image data reading control unit 145 acquires the previous image data from the previous image storing unit 120 through the storage device control unit 144, and outputs the acquired previous image data to the image signal generating unit 146 one pixel by one pixel.

The image signal generating unit 146 is set to a mode of outputting the outline image by the control signal input through the timing signal generating unit 142. That is, the control signal of selecting the input 4 (terminal connected to the NXOR circuit 188) is input to the control terminal SS of the selection circuit 189.

By the operation, the image signal corresponding to the image data D2 shown in FIG. 8C is output from the selection circuit 189. As described above, the image data D2 is obtained by inverting (NXOR) the difference between the expanded image and the contracted image generated from the image data D0, the pixel data "0" is provided in the area B2 of 2-pixel width with the boundary of black and white in the image data D0 interposed therebetween, and the pixel data "1" is provided in the other area. The image signal generating unit 146 outputs the image signal to the data line driving circuit 152 with the timing signal.

As described above, in the embodiment, the second image processing circuit generating the image data used in the second elimination step S102 is formed of the pixel data storing unit 183, the expansion processing circuit 184, the contraction processing circuit 185, the NXOR circuit 188, and the like.

In the second elimination step S102 according to the embodiment, the low level potential VL (e.g., −15 V) is input as the image signal to the pixels 10 corresponding to the area B2 (pixel data "0") of the pixel data D2 shown in FIG. 8C. Meanwhile, the reference potential GND (e.g., 0 V) is input as the image signal to the pixels 10 corresponding to the pixel data "1" represented by black. Accordingly, it is possible to selectively drive the plurality of pixels 10 belonging to the area R2 (the second pixel group) shown in FIG. 8C.

The selection signal generating unit 147 generates a selection signal necessary for image display under the control of the timing signal generating unit 142, and outputs the selection signal to the scanning line driving circuit 151 with the timing signal.

The common power supply control unit 143 outputs a command for supplying the reference potential GND (e.g., 0 V) to the common electrode 25, to the common power supply 163.

In the electro-optical panel 112, the image signal (the low level potential VL or the reference potential GND) based on the image data D2 is input to the pixel electrode 24 of the pixel 10 by the data line driving circuit 151 to which the selection signal is input and the data line driving circuit 152 to which the image signal is input. The reference potential GND is input to the common electrode 25.

Accordingly, in the pixel 10 belonging to the area R2 including the afterimage R1*z*, the electro-optical material layer 26 (the electrophoretic element) operates to display white. As a result, the afterimage R1*z* which cannot be eliminated in the first elimination step S101 is eliminated, and the entire face of the display unit 150 is displayed by uniform white.

When the entire face of the display unit 150 is displayed with white by the second elimination step S102, the image display step S103 is performed.

The image display step S103 is a step of displaying a new image (next image) on the display unit 150, and a next image display operation is repeatedly performed three times (3 frames) in the embodiment.

First, the general control unit 140 outputs a command for performing the image display step S103 to the timing signal generating unit 142 and the common power supply control unit 143.

The timing signal generating unit 142 outputs a command for reading the next image data used in the image display step S103 from the next image storing unit 121 of the storage device 111, to the image data reading control unit 145. The image data reading control unit 145 acquires the next image data (the image data D3 shown in FIG. 8D) from the next image storing unit 121 through the storage device control unit 144, and outputs the acquired previous image data to the image signal generating unit 146 one pixel by one pixel.

The image signal generating unit 146 is set to a mode of outputting the next image by the control signal input through the timing signal generating unit 142. That is, the control signal of selecting the input 1 (terminal connected to the line 171) is input to the control terminal SS of the selection circuit 189.

Figure 8D:
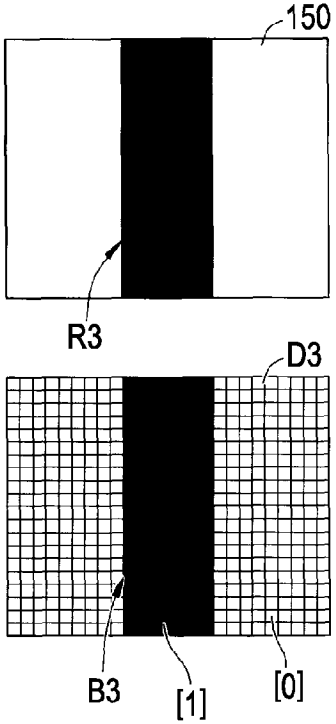

By the operation, the image signal corresponding to the image data D3 shown in FIG. 8D is output from the selection circuit 189. In the image data D3, a black stripe (the area B3) extending up and down on the white background is represented. The pixel data "0" is provided in the area corresponding to the white background, and the pixel data "1" is provided in the area B3. The image signal generating unit 146 outputs the image signal to the data line driving circuit 152 with the timing signal.

In the image display step S103 according to the embodiment, the high level potential VH (e.g., 15 V) is input as the image signal to the pixels 10 corresponding to the area B3 (the pixel data "1" represented by black) of the image data D3 shown in FIG. 8D. Meanwhile, the reference potential GND (e.g., 0 V) is input as the image signal to the pixels 10 corresponding to the pixel data "0" represented by white.

The selection signal generating unit 147 generates a selection signal necessary for image display under the control of the timing signal generating unit 142, and outputs the selection signal to the scanning line driving circuit 151 with the timing signal. The common power supply control unit 143 outputs a command for supplying the reference potential GND (e.g., 0 V) to the common electrode 25, to the common power supply 163.

In the electro-optical panel 112, the image signal (the high level potential VH or the reference potential GND) based on the inverted image of the previous image is input to the pixel electrode 24 of the pixel 10 by the scanning line driving circuit 151 to which the selection signal is input and the data line driving circuit 152 to which the image signal is input. The reference potential GND is input to the common electrode 25. Accordingly, the black stripe-shaped area R3 is represented at the center of the display unit 150.

Even in the image display step S103, the next image display operation to the electro-optical panel 112 is repeatedly performed three times (3 frames). Accordingly, the driving time of the electro-optical material layer 26 is extended, and thus it is possible to obtain the display with a desired contrast.

The display image of the display unit 150 is updated by the steps S101 to S103.

According to the electro-optical device 100 and the method of driving the same of the first embodiment described in detail above, the second elimination step S102 of re-eliminating only the part corresponding to the outline of the area R1 is provided after the first elimination step S101 of selectively eliminating the black image component (the area R1) of the display unit 150, and thus it is possible to reliably eliminate the afterimage R1*z* generated by the selective elimination of the area R1. According to the electro-optical device 100 of the embodiment, it is possible to obtain the high quality display with a reduced afterimage.

In the electro-optical device 100 and the method of driving the same of the embodiment, the first elimination step S101, the second elimination step S102, and the image display step S103 are provided as independent steps, and thus the performing time of the steps can be adjusted by a unit of frames. Particularly, the performing time of the second elimination step S102 can be minutely controlled, and thus it is possible to set the performing time (driving time of the electro-optical material layer 26) necessary and sufficient for the elimination of the afterimage R1*z* and to reliably eliminate the afterimage.

In the electro-optical device 100 and the method of driving the same of the embodiment, the performing time of the second elimination step S102 is shorter than the performing time of the first elimination step S101. Accordingly, it is possible to reliably eliminate the afterimage while securing reliability of the electro-optical panel 112.

As shown in FIG. 8B, most of the area where the afterimage R1*z* occurs is in the white display state, and the afterimage R1*z* is light gray. In the second elimination step S102, the pixels 10 of such an area are further operated to be displayed with white to eliminate the afterimage R1*z*. In this case, when the elimination operation of three frames in the same manner as the first elimination step S101 is performed, the area including the afterimage R1*z* becomes whiter than the surrounding, thereby being an afterimage.

In the second elimination step S102, since the white display operation is repeatedly performed on the pixels 10 which are not operated to be displayed with black, the balance of current history in the electro-optical material layer 26 may break down, the life of the electro-optical material layer 26 may be shortened, or the reliability of the electro-optical panel 112 may be decreased.

From the reasons, it is preferable that the second elimination step S102 is set to as short a time as possible in a range in which the afterimage R1*z* can be eliminated. In the embodiment, the second elimination step S102 is performed in only one frame, and thus it is possible to eliminate the afterimage R1*z* while avoiding the problem of the excessive writing or current balance.

In the embodiment, the number of frames in the second elimination step S102 is changed to adjust the driving time of the electro-optical material layer 26, thereby adjusting a degree of load to the electro-optical material layer 26. However, the degree of the load to the electro-optical material layer 26 may be adjusted by a level (applied voltage) of the image signal input to the pixels 10 in the second elimination step S102. For example, in the embodiment, the low level potential VL of −15 V is input to the pixel electrode 24, but it may be changed to −5 V, and the outline elimination operation may be performed in 3 frames in the same manner as the other step. Even in this case, it is possible to eliminate the afterimage R1*z* while avoiding the problem of excessive writing and current balance.

In the embodiment, in the second elimination step S102, the frame-shaped area B2 (the area formed of the second pixel group) of 2-pixel width with the outline of the area B0 (the area formed of the first pixel group) in the image data D0 of the previous image interposed therebetween is the elimination target area, but the width of the area B2 is not limited to the 2-pixel width, and may be 3-pixels in width or more. The direction of expanding the area B2 may be any of the inward direction and the outward direction of the area B1 (the area formed of the first pixel group) shown in FIG. 8B.

As shown in FIG. 8C, the pixel data "0" may not be provided at a position corresponding to angled portions A1 of the area R1, and the pixel data "0" may be provided at the angled portions A1.

In the embodiment, in the first elimination step S101 and the second elimination step S102, the entire display unit 150 is displayed in the single gradation of white, but a part of the display unit 150 may be displayed with the single gradation of white. In this case, in a part of the range of the display unit 150, the first elimination step S101, the second elimination step S102, and the image display step S103 are performed.

In the embodiment, white and black may be changed to each other. That is, the black may be the first gradation, the white may be the second gradation, a part or the entire display unit 150 may be displayed with black (the first gradation) in the first elimination step S101 and the second elimination step S102.

Second Embodiment

Next, a second embodiment of the invention will be described with reference to FIG. 9 to FIG. 10D.

Figure 9:
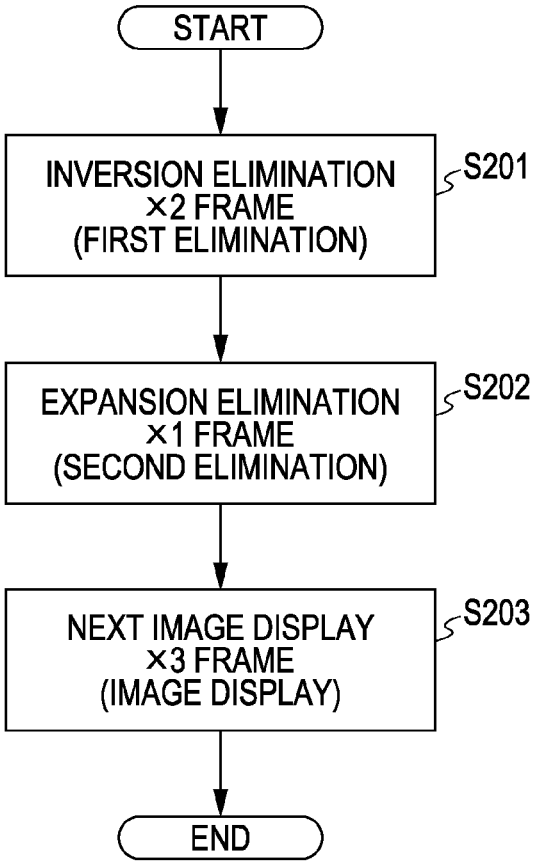
FIG. 9 is a flowchart illustrating a method of driving an electro-optical device according to a second embodiment.
Figure 10A:
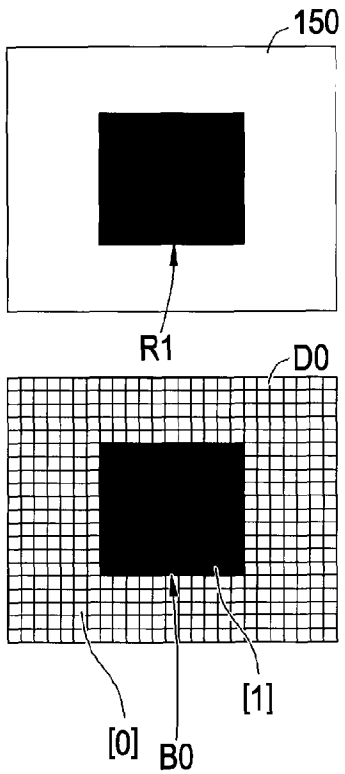
FIG. 10A to FIG. 10D are diagrams illustrating a form of transition of a display unit with image data.
Figure 10B:
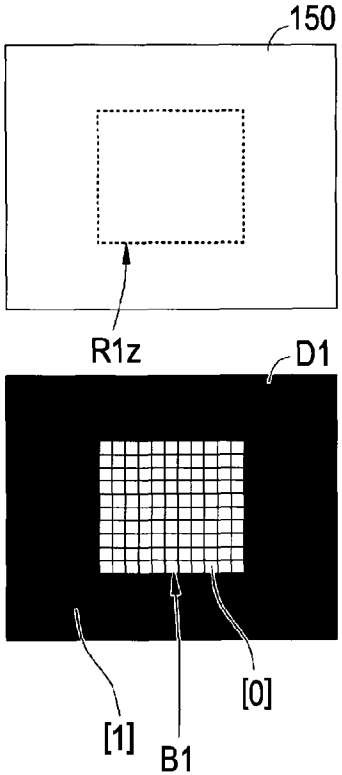
Figure 10C:
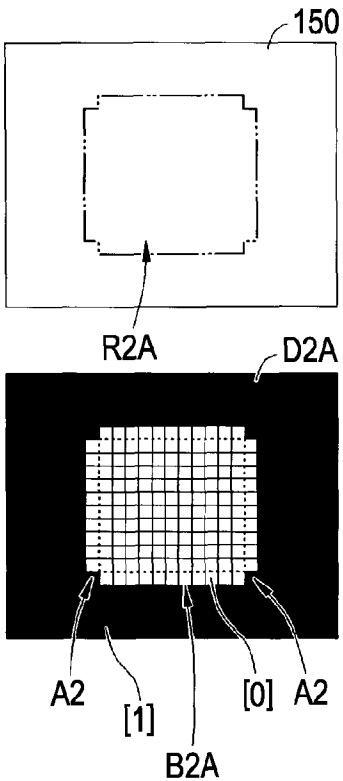
Figure 10D:
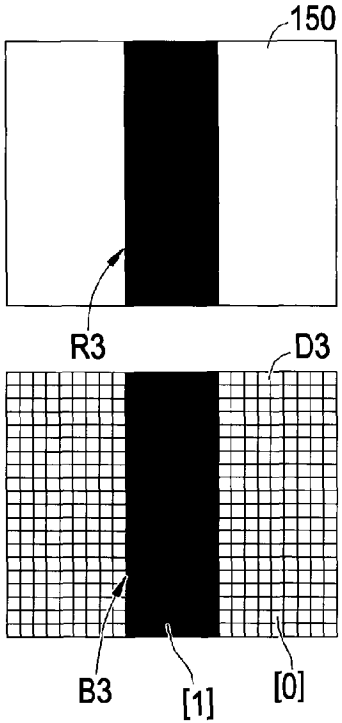

FIG. 9 is a flowchart illustrating a method of driving an electro-optical device according to the second embodiment. FIG. 10A to FIG. 10D are diagrams illustrating a form of transition of a display unit of an electro-optical panel with image data used in steps.

A hardware configuration of the electro-optical device of the embodiment is the same as the electro-optical device 100 of the first embodiment, and a driving method using the electro-optical device 100 will be described hereinafter.

The flowchart shown in FIG. 9 shows a series of flow when updating the display image of the electro-optical device 100, and includes a first elimination step S201, a second elimination step S202, and an image display step S203. FIG. 10A is a diagram illustrating a display state of the display unit 150 before display update and image data D0 used in the display. The upper parts of FIG. 10B to FIG. 10D are diagrams illustrating the display state of the display unit 150 corresponding to the execution result of the steps S201 to S203, and the lower parts of FIG. 10B to FIG. 10D are diagrams illustrating the image data D1, D2A, and D3 used in the steps S201 to S203.

In the driving method of the embodiment, by performing the first elimination step S201 and the second elimination step S202, the entire face is displayed with white (first gradation) by eliminating the rectangular image of black (second gradation) from the display unit 150 shown in FIG. 10A. Thereafter, by performing the image display step S203, a black stripe-shaped image shown in FIG. 10D is displayed on the display unit 150.

In a case of updating the display of the electro-optical panel 112 by the driving method of the embodiment, first, the CPU 102 transmits a panel driving request including the image data (next image data) displayed at the next time to the display unit control device 110.

The display unit control device 110 receiving the panel driving request stores the received next image data (image data D4 shown in FIG. 10D) in the next image storing unit 121 of the storage device 111. Thereafter, the steps S201 to S203 that are a preset driving sequence are sequentially performed by the general control unit 140.

First, in the first elimination step S201, configurations other than the number of frames of the image signal input are the same as the first elimination step S101 according to the first embodiment. That is, in the first elimination step S201, the inversion elimination operation using the image data D1 shown in FIG. 10B is performed over 2 frames. Accordingly, the pixels 10 belonging to the area R1 (the first pixel group) displayed with black (the second gradation) of the display unit 150 are selectively changed to the display of white (the first gradation).

In the embodiment, the first image processing circuit generating the image data D1 used in the first elimination step S201 is the NOT circuit 186 shown in FIG. 4.

According to the first elimination step S201, the display unit 150 can be changed to an almost white display state. However, in the same manner as the first embodiment, as shown in FIG. 10B, the gray line (the afterimage R1*z*) remains along the outline of the area R1 shown in FIG. 10A. Even in the driving method of the embodiment, the afterimage R1*z* is eliminated by the subsequent second elimination step S202.

In the second elimination step S202 of the embodiment, image data D2A different from that of the second elimination step S102 according to the first embodiment is used. As shown in FIG. 10C, the image data D2A has an area B2A with a shape of expanding the area B1 of the image data D1 shown in FIG. 10B outward from the sides by one pixel. The pixel data "0" is provided in the area B2A, and the pixel data "1" is provided in the other area. In the image data D2A shown in FIG. 10C, the pixel data "1" represented by black is provided at angled portions A2 of the area B2A, but the pixel data "0" represented by white may be provided at the angled portions A2.

As described above, the second image processing circuit generating the image data D2A used in the second elimination step S202 of the embodiment is formed of the pixel data storing unit 183, the expansion processing circuit 184, and the NOT circuit 187 shown in FIG. 4.

In the second elimination step S202, the expansion elimination operation using the image data D2A shown in FIG. 10C is performed for only one frame.

Specifically, the general control unit 140 outputs a command for performing the second elimination step S202 to the timing signal generating unit 142 and the common power supply control unit 143.

The timing signal generating unit 142 outputs a command for reading the previous image data used in the second elimination step S202 from the previous image storing unit 120 of the storage device 111, to the image data reading control unit 145. The image data reading control unit 145 acquires the previous image data from the previous image storing unit 120 through the storage device control unit 144, and outputs the acquired previous image data to the image signal generating unit 146 one pixel by one pixel.

The image signal generating unit 146 is set to a mode of outputting the expanded image by the control signal input through the timing signal generating unit 142. That is, the control signal of selecting the input 3 (terminal connected to the NOT circuit 187) is input to the control terminal SS of the selection circuit 189.

By the operation, the image data D2A shown in FIG. 10C is output from the selection circuit 189. The image signal generating unit 146 outputs the image signal to the data line driving circuit 152 with the timing signal.

In the second elimination step S202 according to the embodiment, the low level potential VL (e.g., −15 V) is input as the image signal to the pixels 10 corresponding to the area B2A (pixel data "0") of the pixel data D2A shown in FIG. 10C. Meanwhile, the reference potential GND (e.g., 0 V) is input as the image signal to the pixels 10 corresponding to the pixel data "1" represented by black. Accordingly, in the display unit 150, it is possible to selectively drive the plurality of pixels 10 of the area R2A (the second pixel group) set to include the afterimage R1*z*.

The selection signal generating unit 147 generates a selection signal necessary for image display under the control of the timing signal generating unit 142, and outputs the selection signal to the scanning line driving circuit 151 with the timing signal.

The common power supply control unit 143 outputs a command for supplying the reference potential GND (e.g., 0 V) to the common electrode 25, to the common power supply 163.

In the electro-optical panel 112, the image signal (the low level potential VL or the reference potential GND) based on the image data D3 is input to the pixel electrode 24 of the pixel 10 by the scanning line driving circuit 151 to which the selection signal is input and the data line driving circuit 152 to which the image signal is input. The reference potential GND is input to the common electrode 25.

Accordingly, in the pixel 10 belonging to the area R2A including the afterimage R1*z*, the electro-optical material layer 26 (the electrophoretic element) operates to display white. As a result, the afterimage R1*z* which cannot be eliminated in the first elimination step S101 is eliminated, and the entire face of the display unit 150 is displayed by uniform white.

When the entire face of the display unit 150 is displayed with white by the second elimination step S202, the image display step S203 is performed. The image display step S203 is the same as the image display step S103 according to the first embodiment, and the next image display operation is repeatedly performed three times (3 frames). By the image display step S203, the image signal based on the image data D3 shown in FIG. 10D is input to the pixels 10, and the next image shown in FIG. 10D is displayed on the display unit 150.

According to the driving method of the second embodiment described in detail above, the second elimination step S202 of re-eliminating the area (the second pixel group) including the area R1 (the first pixel group) and the area outside by one pixel is provided after the first elimination step S201 of selectively eliminating only the black image component (the area R1) of the display unit 150, and thus it is possible to reliably eliminate the afterimage R1z generated by the selective elimination of the area R1. According to the driving method of the embodiment, it is possible to obtain the high quality display with a reduced afterimage.

The driving method of the second embodiment is different from the driving method of the first embodiment in that the first elimination step S201 is performed in two frames. The reason is that only the part corresponding to the vicinity of the outline of the area R1 is re-eliminated in the second elimination step S102 in the first embodiment, but the part corresponding to the area R1 is also re-eliminated in the second elimination step S202 in the second embodiment. That is, it is because, when the first elimination step S201 is performed in three frames, the area R1 is repeatedly eliminated total four times, reliability of the electro-optical panel 112 may be decreased by occurrence of the afterimage caused by excessive writing or by breakdown of current balance.

In the case of the driving method of the second embodiment, the total number of frame is smaller than that of the first embodiment, and thus it is possible to improve a display speed (an elimination speed) and to reduce power consumption.

In the case of performing only the driving method of the second embodiment, the contraction processing circuit 185 shown in FIG. 4 is not necessary, and thus it is possible to simplify the configuration of the control circuit (the display unit control device).

In the first embodiment and the second embodiment described above, the first elimination steps S101 and S201 are first performed, and then the second elimination steps S102 and S202 are performed, but the invention is not limited thereto. That is, the second elimination steps S102 and S202 may be first performed, and then the first elimination steps S101 and S201 may be performed.

The first elimination steps S101 and S201 and the second elimination steps S102 and S202 may be alternately performed many times. In this case, the number of frames in each step may be modified.

For example, as a driving method obtained by modifying the first embodiment, there may be a driving method of performing different operations for each one frame, such as the first elimination step S101 (inversion elimination operation×1 frame), the second elimination step S102 (outline elimination operation×1 frame), the first elimination step S101 (inversion elimination operation×1 frame), and the second elimination step S102 (outline elimination operation×1 frame).

As a driving method obtained by modifying the second embodiment, there may be a driving method of sequentially performing the elimination in order of the first elimination step S201 (inversion elimination operation×1 frame), the second elimination step S102 (expansion elimination operation×1 frame), and the first elimination step S201 (inversion elimination operation×1 frame).

In the description of the embodiments, the image signal is a binary value of black and white, but it is obvious that halftone display may be performed. For example, when the previous image includes a black image component (Pb), a white image component (Pw), and a halftone image component (Pm), the pixels 10 corresponding to the image components (the black image component Pb and the halftone image component Pm) other than white in the first elimination step S101 according to the first embodiment are selectively operated. Alternatively, after the pixels 10 corresponding to the halftone image component Pm are selectively changed to the white display, the pixels 10 corresponding to the black image component Pb are selectively changed to the white display.

When the first elimination step S101 is performed, an afterimage is generated at the boundary of the white image component Pw and the other image components Pb and Pm. Accordingly, in the second elimination step S102, it is preferable to set the elimination area to include the outline of the image components Pb and Pm.

In the embodiments, the image obtained by expanding the area of the black image component in the expansion processing circuit 184 is generated, and the image obtained by contracting the area of the black image component in the contraction processing circuit 185 is generated. However, it is obvious that the process target of the expansion processing circuit 184 and the contraction processing circuit 185 may be the white image component.

In the embodiments, in the image signal generating unit 146 built in the electro-optical device 100, the image data is generated using the first elimination steps S101 and S201 and the second elimination steps S102 and S202, but the image data used in the steps may be produced in advance by a PC or the like and stored in the program memory 113.

Electronic Apparatus

Next, a case of applying the electro-optical device according to the embodiments to an electronic apparatus will be described.

Figure 11:
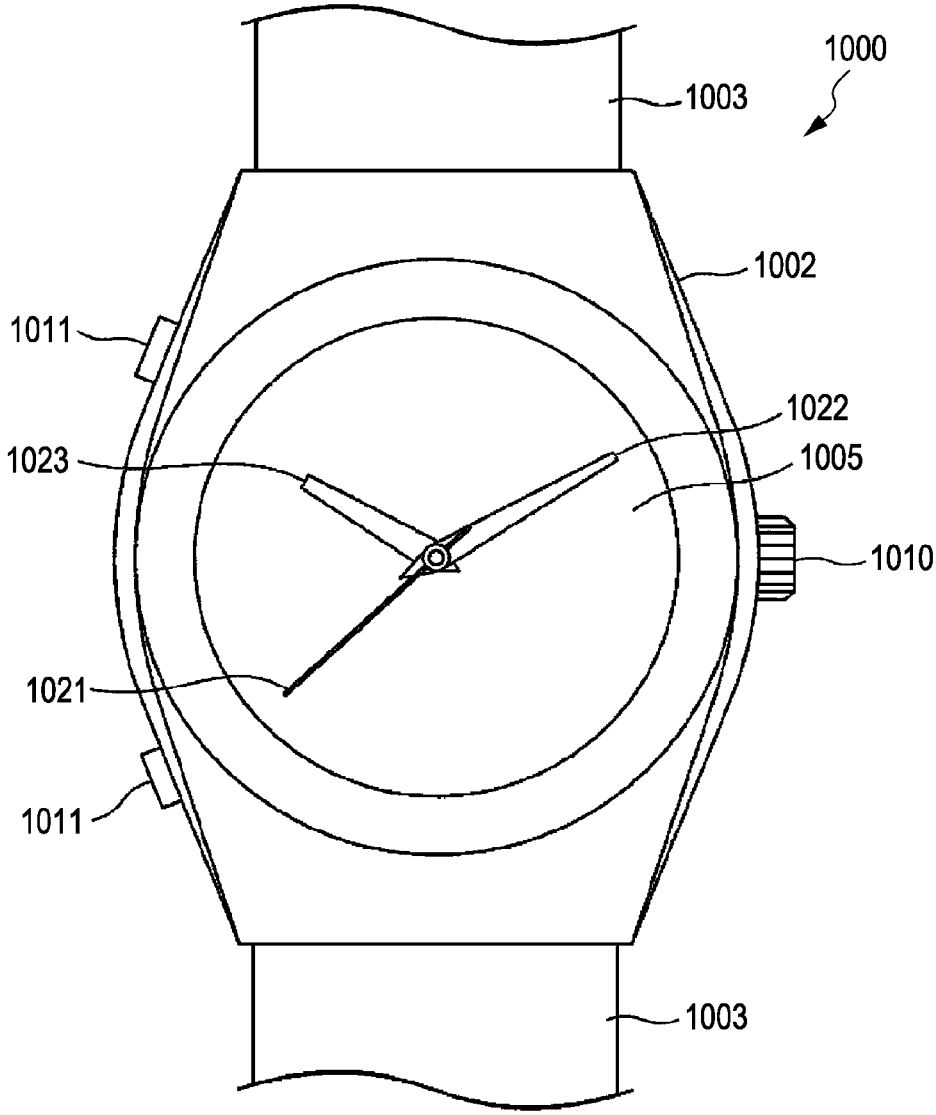
FIG. 11 is a diagram illustrating an example of an electronic apparatus.

FIG. 11 is a front view of a watch 1000. The watch 1000 is provided with a watch case 1002, and a set of bands 1003 coupled to the watch case 1002.

On the front side of the watch case 1002, a display unit 1005 formed of the electro-optical device of the embodiments, a second hand 1021, a minute hand 1022, and an hour hand 1023 are provided. On the side of the watch case 1002, a winder 1010 and operation buttons 1011 as operators are provided. The winder 1010 is linked with a winding core (not shown) provided in the case, is integrated into the winding core, is freely pushed and pulled multiple steps (e.g., 2 steps), and is rotatably provided. On the display unit 1005, a background image, a character line such as date and time, a second hand, a minute hand, an hour hand, and the like may be displayed.

Figure 12:
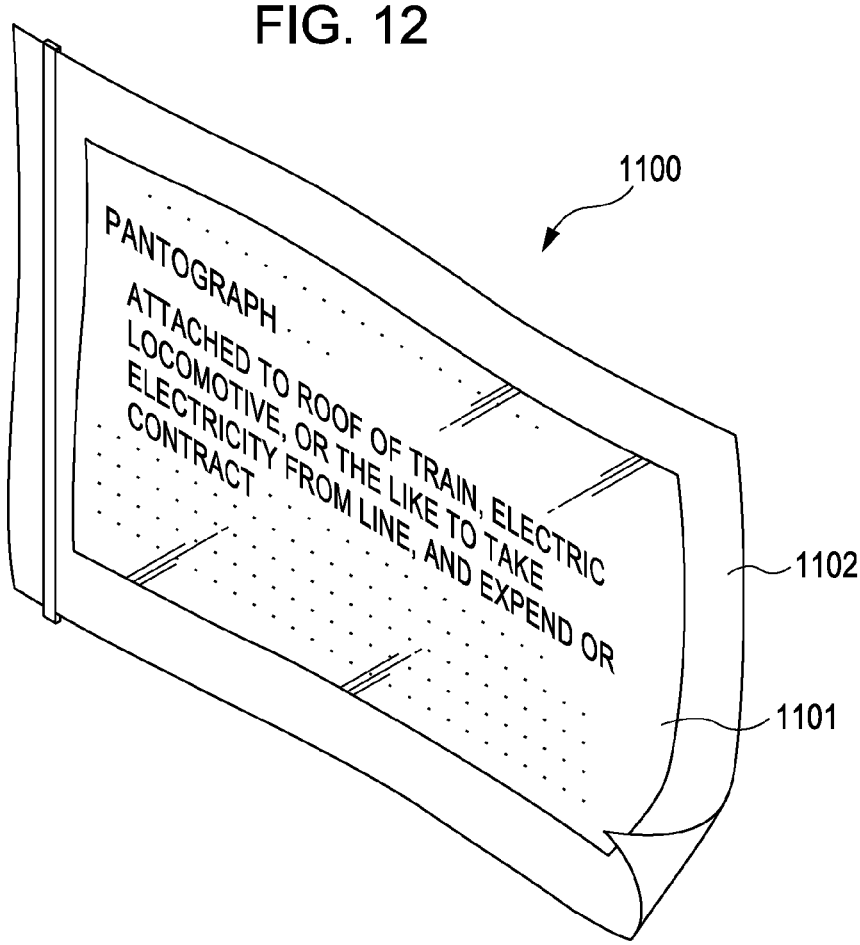
FIG. 12 is a diagram illustrating an example of an electronic apparatus.

FIG. 12 is a perspective view illustrating a configuration of an electronic paper 1100. The electronic paper 1100 is provided with the electro-optical device of the embodiments as a display area 1101. The electronic paper 1100 has flexibility, and is provided with a body 1102 formed of a rewritable sheet having the same material feel and softness as the known paper.

Figure 13:
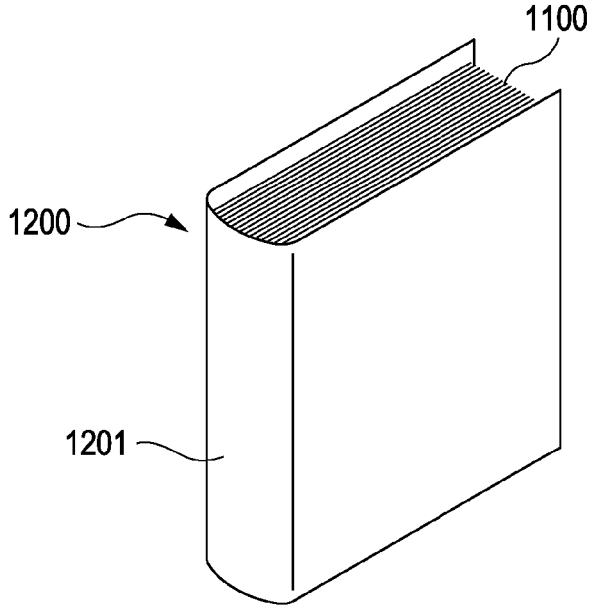
FIG. 13 is a diagram illustrating an example of an electronic apparatus.

FIG. 13 is a perspective view illustrating a configuration of an electronic note 1200. The electronic note 1200 is formed by putting plural sheets of electronic papers 1100 in a cover 1201. The cover 1201 is provided with, for example, display data input means (not shown) for inputting display data transmitted from an external device. Accordingly, it is possible to change or update the contents with the electronic papers bound according to the display data.

According to the above-described watch 1000, the electronic paper 1100, and the electronic note 1200, it is possible to provide an electronic apparatus provided with the display means capable of displaying with high quality since the electro-optical device according to the invention is employed.

The above-described electronic apparatuses are examples of the electronic apparatus according to the invention, and do not limit the technical scope of the invention. For example, the invention may be very appropriately used as a display unit of an electronic apparatus such as a mobile phone and a portable audio device.

The entire disclosure of Japanese Patent Application No. 2010-055578, filed Mar. 12, 2010 is expressly incorporated by reference herein.

What is claimed is:

1. An electro-optical device comprising:

a display unit that includes an electro-optical material layer interposed between a pair of substrates and a plurality of arranged pixels; and a control unit that controls driving of the display unit, wherein when a part or the entirety of the display unit is displayed in a single gradation, the control unit performs a first elimination operation of selectively driving a first pixel group including the pixels displayed in gradations other than a first gradation to change the pixels included in the first pixel group to the first gradation, and a second elimination operation of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

2. The electro-optical device according to claim 1, wherein the second pixel group is composed of sets of two pixels adjacent to each other with the outline of the area formed of the first pixel group.

3. The electro-optical device according to claim 1, wherein the second pixel group further including the pixels included in the first pixel group.

4. The electro-optical device according to claim 3, wherein the second pixel group is an area expanding the area formed of the first pixel group outward by one pixel.

5. The electro-optical device according to claim 1, wherein the display unit is provided with a plurality of scanning lines and a plurality of data lines extending in an intersection direction, and the plurality of pixels are provided at positions corresponding to the intersections of the plurality of scanning lines and the plurality of data lines, and wherein when a period of sequentially selecting the plurality of scanning lines once is one frame, the control unit performs the first elimination operation over a plurality of frames and performs the second elimination operation with the number of frames smaller than the number of frames of the first elimination operation.

6. The electro-optical device according to claim 1, wherein voltage applied to the electro-optical material layer of the pixels in the second elimination operation is lower than voltage applied to the electro-optical material layer of the pixels in the first elimination operation.

7. An electronic apparatus comprising the electro-optical device according to claim 1.

8. A method of driving an electro-optical device provided with a display unit including an electro-optical material layer interposed between a pair of substrates and a plurality of arranged pixels, wherein when a part or the entirety of the display unit is displayed in a single gradation, the method comprising:

selectively driving a first pixel group including the pixels displayed in gradations other than a first gradation to change the pixels included in the first pixel group to the first gradation, and selectively driving a second pixel group including the pixels positioned on an outline of an area formed of the first pixel group and the plurality of pixels provided adjacent to the area formed of the first pixel group and surrounding the area to change the pixels included in the second pixel group to the first gradation.

9. The method of driving the electro-optical device according to claim 8, wherein the second pixel group further including the pixels included in the first pixel group.

10. The method of driving the electro-optical device according to claim 8, wherein during selectively driving the first pixel group, the same image signal is written to the pixels a plurality of times, and during selectively driving the second pixel group, the number of writings to the pixels is smaller than the number of writings of the first elimination step.

11. The method of driving the electro-optical device according to claim 8, wherein during selectively driving the second pixel group, voltage applied to the electro-optical material layer of the pixels is lower than voltage applied to the electro-optical material layer of the pixels in the first elimination step.

12. A control circuit of an electro-optical device provided with a display unit including an electro-optical material layer interposed between a pair of substrates and a plurality of arranged pixels, wherein when a part or the entirety of the display unit is displayed in a single gradation, the control circuit performs a first elimination operation of selectively driving a first pixel group including the pixels displayed in gradations other than a first gradation to change the pixels included in the first pixel group to the first gradation, and a second elimination operation of selectively driving a second pixel group including the pixels positioned on the outline of an area formed of the first pixel group and the plurality of pixels provided adjacent to the area formed of the first pixel group and surrounding the area to change the pixels included in the second pixel group to the first gradation.

13. The control circuit according to claim 12, comprising an image signal generating circuit that generates an image signal transmitted to the display unit, wherein the image signal generating circuit has a first image processing circuit generating an image signal used in the first elimination operation and a second image processing circuit generating an image signal used in the second elimination operation, wherein the first image processing circuit has a circuit reversely outputting image data corresponding to the image displayed on the display unit, wherein the second image processing circuit includes a pixel data storing unit that stores process target pixel data of the image data and a plurality of pixel data adjacent to the process target pixel data, an expansion processing circuit that receives an input of the plurality of pixel data from the image data storing unit, and changes and outputs the process target pixel data to a value corresponding to the second gradation when even any one of the plurality of pixel data is a value corresponding to the second gradation other than the first gradation, a contraction processing circuit that receives an input of the plurality of pixel data from the image data storing unit, and changes and outputs the process target pixel data to a value corresponding to the first gradation when even any one of the plurality of pixel data is a value corresponding to the first gradation, and a circuit that outputs an exclusive NOR value of the output signal of the expansion processing circuit and the output signal of the contraction processing circuit.

14. The control circuit according to claim 12, wherein the second pixel group further including the pixels included in the first pixel group.

15. The control circuit according to claim 14, comprising an image signal generating circuit that generates an image signal transmitted to the display unit, wherein the image signal generating circuit has a first image processing circuit generating an image signal used in the first elimination operation and a second image processing circuit generating an image signal used in the second elimination operation, wherein the first image processing circuit has a circuit reversely outputting image data corresponding to the image displayed on the display unit, wherein the second image processing circuit includes a pixel data storing unit that stores process target pixel data of the image data and a plurality of pixel data adjacent to the process target pixel data, an expansion processing circuit that receives an input of the plurality of pixel data from the image data storing unit, and changes and outputs the process target pixel data to a value corresponding to the second gradation when even any one of the plurality of pixel data is a value corresponding to the second gradation other than the first gradation, and a circuit that reversely outputs the output signal of the expansion processing circuit.

* * * * *